US006126789A

United States Patent [19]

Schiel et al.

[11] Patent Number: 6,126,789

[45] Date of Patent: Oct. 3, 2000

[54] SHOE PRESS

[75] Inventors: Christian Schiel, Murnau; Andreas Schuette, Heidenheim; Wolfgang Schuwerk, Kisslegg; Joachim Grabscheid, Heuchlingen; Werner Leitenberger, Schlier-Wetzisreute; Uwe Matuschczyk, Geislinger; Christian Steger, Konstanz; Wolf Gunter Stotz, Ravensburg, all of Germany

[73] Assignee: Voith Sulzer Papiermaschinen GmbH, Heidenheim, Germany

[21] Appl. No.: 08/963,824

[22] Filed: Nov. 4, 1997

[30] Foreign Application Priority Data

Nov. 4, 1996 [DE] Germany ..... 196 45 407

[51] Int. Cl.[7] ..... D21F 3/02

[52] U.S. Cl. ..... 162/358.3; 162/358.4; 100/118; 100/153; 492/16; 492/20

[58] Field of Search ..... 162/357, 358.3, 162/358.4, 361, 205; 100/118, 153; 492/16, 20

[56] References Cited

U.S. PATENT DOCUMENTS

| | | | |
|---|---|---|---|
| 3,804,707 | 4/1974 | Mohr et al. . | |
| 4,570,314 | 2/1986 | Holik et al. . | |
| 4,673,461 | 6/1987 | Roerig et al. . | |
| 5,753,083 | 5/1998 | Schiel et al. | 162/358.3 |

FOREIGN PATENT DOCUMENTS

| | | |
|---|---|---|
| 0224428 | 6/1987 | European Pat. Off. . |
| 0389458 | 9/1990 | European Pat. Off. . |
| 3126492 | 1/1983 | Germany . |
| 3338487 | 5/1985 | Germany . |
| 2182367 | 5/1987 | United Kingdom . |
| 9100937 | 1/1991 | WIPO . |

OTHER PUBLICATIONS

Copy of a European Search Report dated Mar. 2, 1998 issued in connection with European Patent Application No. 97 116 757.2–2314.

Copy of a German Search Report dated Feb. 24, 1997 issued with DE 196 45 407.7.

*Primary Examiner*—Peter Chin

*Attorney, Agent, or Firm*—Greenblum & Bernstein, P.L.C.

[57] ABSTRACT

A shoe press, in particular for a paper machine, comprising a pair of rolls, with one roll having a flexible roll sleeve that rotates around a stationary carrier and support devices, the flexible roll sleeve having axial end areas and being mounted on a carrier in a radially rotatable manner at each of its axial end areas over the support devices, each roll having a shoe with a flat support surface, the support surface of the shoe of one roll supporting an interior side of the roll sleeve, the support surfaces being arranged essentially parallel to each other to create a press opening therebetween, and at least one of the support devices being radially flexible, and in particular elastic.

46 Claims, 4 Drawing Sheets

SHOE PRESS

The present application claims the priority under 35 U.S.C. § 119 of German Patent Application No. 196 45 407.7 filed Nov. 4, 1996.

BACKGROUND OF THE INVENTION

1. Field of the Invention

The present invention relates to a shoe press, in particular a shoe press for a paper machine, including at least one roll consisting of a flexible roll sleeve that circulates around a stationary carrier and is rotatably mounted on the carrier at each of its two axial end areas over a support device, and at least one shoe that has a support surface for the interior side of the roll sleeve.

2. Discussion of Background Information

In shoe presses of this type, a flexible roll sleeve is usually pressed against a rigid mating roll by a press shoe which curves inward in a concave manner. A press opening is thus created between the press roll and the mating roll that has a certain length, which is also referred to as that press zone length, in the feed direction of the pressed material. The longer the press zone, the greater the press impulse which is applied, for a given contact pressure of the press shoe onto the pressed material. Therefore, the contact pressure of the press shoe can differ across the press zone in the feed direction of the pressed material, thereby exhibiting pressure gradients.

When paper is the material to be pressed, for example, increasing demands are placed on its dryness content, smoothness and volume, among other things. A goal, therefore, is to increase the press impulse. At the same time, however, the maximum pressure and the pressure gradient in the press opening should be kept at a minimum.

In order to achieve this, extensions of the press zone, i.e. of the press shoe, can be considered. These are limited to the length of approximately 300 mm which is achievable today, however, since increased shoe length causes the dipping depth of the flexible roll sleeve to correspondingly be increased, because of the concave supporting surface of the press shoe which matches the surface of the mating roll. Increased dipping of the flexible roll sleeve has the disadvantage, among other things, of strong roll sleeve bending at the inlet and outlet areas of the press opening. Deformations in the edge areas of the press shoe are particularly strong and critical, since a transition in the axial direction to a circular cylindrical form, influenced by the radial support of the roll sleeve, also occurs at this location.

SUMMARY OF THE INVENTION

An object of the invention is to further develop a shoe press of the type described above so that these disadvantages do not arise. In particular, an object is to decrease the deformation of the roll sleeve in the areas of the two axial edges of the press shoe.

This object of the invention is achieved by designing two rolls, each having a shoe with a flat support surface, wherein the support surfaces of the shoes are essentially parallel and in opposing relation to one another, and thus create a press opening therebetween, and by constructing at least support device of a roll that is radially flexible, and in particular elastic.

Radial flexibility of the roll support device results in the roll sleeve mounting having radial elasticity, such that the roll sleeve can also be radially deformed in the area of the mounting. Hence, less alternating bending or deformation occurs in the areas of the axial edges of the shoes during operation of the roll. Due to the press shoes having flat support surfaces, the dipping depth of the roll sleeve during operation of the roll in the area of the press zone is reduced by approximately one had; compared with usual shoe presses having a rigid mating roll. Together with the radial flexibility of the roll sleeve support device on the carrier, only a very slight deformation of the roll sleeve results overall.

According to one embodiment of the invention, at least one of the two rolls has radially flexible support devices for both axial end areas of its roll sleeve. The radially flexible support devices of the rolls are preferably positioned in opposing relation to the axial ends of the press shoe of the other roll, and can be supported thereon. The radially flexible support devices thus receive additional guidance. In addition, a three-dimensional deformation of the roll sleeve of the press roll in the area between the press shoe and the roll sleeve support in avoided, since due to the rotating of the flexible support devices against the shoe of the mating roll, the support devices are deformed in the same way as the roll sleeve in the area of the shoe of the press roll. The mating roll can be provided with rigid support devices for its roll sleeve without an overly strong deformation of the roll sleeve occurring.

According to another embodiment of the invention, each rolls has a radially flexible support device for one axial end area of its roll sleeve. These support devices are designed for opposite axial ends of the two rolls, and each opposite axial end of the shoe is positioned in opposing relation to the other roll, and can be supported thereon. The other support device of each roll can be designed as a rigid tightening disk. Due to this asymmetrical sleeve support, very little roll sleeve deformation occurs. Both rolls are constructed essentially the same and can have the same width. In addition, the width of press opening can be greater.

According to yet another embodiment of the invention, two rolls are designed which each have a radially flexible support devices for both axial end areas of its roll sleeve. The support devices are arranged in pairs, in opposing relation to one another. Thus, in this embodiment, the support devices rotate against each other, ensuring minimal sleeve deformation. Further, the two rolls are designed essentially to correspond with each other.

A radially flexible support device is preferably provided in the form of a rim with a flexible tube, in particular a tube filled with air. Such a device is inexpensive to construct, and it allows for adjustment to the radial flexibility of the support device through changes in the air pressure in the tube. According to another embodiment of the invention, a strap clamp can be designed on the rim.

According to yet another embodiment of the invention, the diameter of the rim is variable. Radially adjustable elements of the rim are preferred. By changing the rim diameter, the pressing force of the rim on the mating roll, and thus the flexibility and deformation of the roll sleeve, can be controlled.

According to yet another embodiment of the invention, an additional sealing tube can be designed within the first tube in order to facilitate construction.

The roll sleeve and the tube should preferably be connected in an interlocking manner, whereby the tube, in particular on its contact side, is designed with notches extending in a circumferential direction, into which corresponding projections on the interior side of the roll sleeve engage. According to this embodiment, a firm connection between the tube and the roll sleeve is created which can withstand the stresses imposed by deformation of the tube during operation of the roll. In addition, in this embodiment the contacting surface is increased, so that the strength of the connection is also increased if the roll sleeve and the tube are glued together.

According to other embodiments of the invention, eccentric tightening disks can be designed as inflexible support devices, and a shoe can be asymmetrically positioned in at least one roll. With this embodiment, the two rolls preferably have essentially the same diameter.

The present invention provides a shoe press that includes: a pair of rolls, with one roll having a flexible roll sleeve that rotates around a stationary carrier and support devices; the flexible roll sleeve having axial end areas and being mounted on a carrier in a radially rotatable manner at each of its axial end areas over the support devices; each roll having a shoe with a flat support surface; the support surface of the shoe of one roll supporting an interior side of the roll sleeve; the support surfaces being arranged essentially parallel to each other to create a press opening therebetween; and at least one of the support devices being radially flexible. The pair of rolls may include inflexible support devices having eccentric tightening disks. Moreover, the shoes of the press roll may be asymmetrically positioned with respect to each other. Further, each roll may have essentially the same diameter. The shoe press may be adapted for use in a paper machine. Moreover, at least one of the support devices may be radially flexibly elastic.

The other roll of the shoe press may include a flexible roll sleeve having axial end areas, each roll may have a radially flexible support device for each axial end area of its roll sleeve, and the support devices may be arranged in pairs and in opposing relation to one another. The support devices may be radially flexible support device positioned at each axial end area of the one roll. In this shoe press, the other roll of the pair of rolls may have the radially flexible support devices of the one roll being positioned opposite at least one axial end of its shoe and be supported thereon. In this press shoe, the other roll may include a roll sleeve that has anal end areas and rigid tightening disks to support the axial end areas of its other roll sleeve.

According to one aspect of the present invention, each roll of the shoe press may have a radially flexible support device at an axial end area of its roll sleeve, the radially flexible support devices may be located on opposite ends of the respective roll sleeves, and an axial end of each shoe may be positioned in a supporting arrangement opposite the radially flexible support device of the opposing roll. Each roll of this shoe press also may include a rigid tightening disk to support the opposite axial end area.

According to another aspect of the invention, the support device of the shoe press may be formed as a rim. This rim may include an air-filled tube. The rim may include a strap clamp on the rim. The diameter of the rim may be variably adjustable. Further, the rim may be radially adjustable elements. Moreover, the air-filled tube may include an additional sealing tube. The roll sleeve and the air-filed tube of the shoe press may be interlockingly connectable. According to this aspect of the press shoe, the air-filled tube may include notches on its contact side located in a circumferential direction, and the interior side of the roll sleeve may have projecting pieces to engage with the notches.

The present invention also provides a shoe press for a web processing machine that includes: a first and second roll positioned in opposing relation to one another, each roll having a roll sleeve and support devices; the first roll including a flexible roll sleeve having axial ends area, the flexible roll sleeve rotating around a stationary carrier; the axial end areas being mounted over the pair of support devices in a radially rotatable manner; a pair of opposing shoes having flat support surfaces, each roll including one of the pair of opposing shoes and each opposing shoe supporting a roll sleeve interior surface; the flat support surfaces being positioned substantially parallel to each other to create a press opening therebetween; and at least one of the pair of support devices being radially flexible. One of the first and second rolls may have inflexible support devices that include eccentric tightening disks. The opposing shoes of the shoe press may be asymmetrically positioned with respect to each other. Moreover, at least one of the pair of opposing shoes may be radially adjustable. Further, each roll may have substantially the same diameter. At least one of the support devices may be radially flexibly elastic.

The second roll of the shoe press may include a flexible roll sleeve having axial end areas, each roll may have a radially flexible support device for each axial end area of its roll sleeve, and the support devices of each roll may be arranged in opposing relation to one another. The first roll of the press roll may have a radially flexible support device positioned at each axial end area of its roll sleeve. In this press shoe, the radially flexible support devices of the first roll may be positioned opposite at least one axial end of the shoe of the second roll and be supported thereon. In this press shoe, the second roll may include a roll sleeve that has axial end areas and rigid tightening disks to support the axial end areas of its roll sleeve.

According to one aspect of the present invention, each roll of the shoe press may have a radially flexible support device at an axial end area of its roll sleeve, the radially flexible support devices may be located on opposite ends of the respective roll sleeves, and an axial end of each shoe may be positioned in a supporting arrangement opposite the radially flexible support device of the opposing roll. Each roll of this shoe press also may include a rigid tightening disk to support the opposite axial end area.

According to another aspect of the invention, the radially flexible support device may include an air-filled tube. This shoe press may include a strap clamp on the radially flexible support device. Alternatively, the radially flexible support device may include an additional sealing tube within the air-filled tube. The diameter of the radially flexible support device may be variably adjustable, and the device may include radially adjustable elements. The roll sleeve and the air-filled tube being interlockingly connectable. Further, the air-filled tube may have notches on its contact side located in a circumferential direction, and the interior side of the roll sleeve may have projecting pieces that engage with the notches.

BRIEF DESCRIPTION OF THE DRAWING

The present invention is further described in the detailed description which follows, in reference to the noted drawings by way of non-limiting examples of preferred embodiments of the present invention, wherein.

DETAILED DESCRIPTION

The particulars shown herein are by way of example and for purposes of illustrative discussion of the preferred embodiments of the present invention only, and are presented to provide what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

Figure 1:
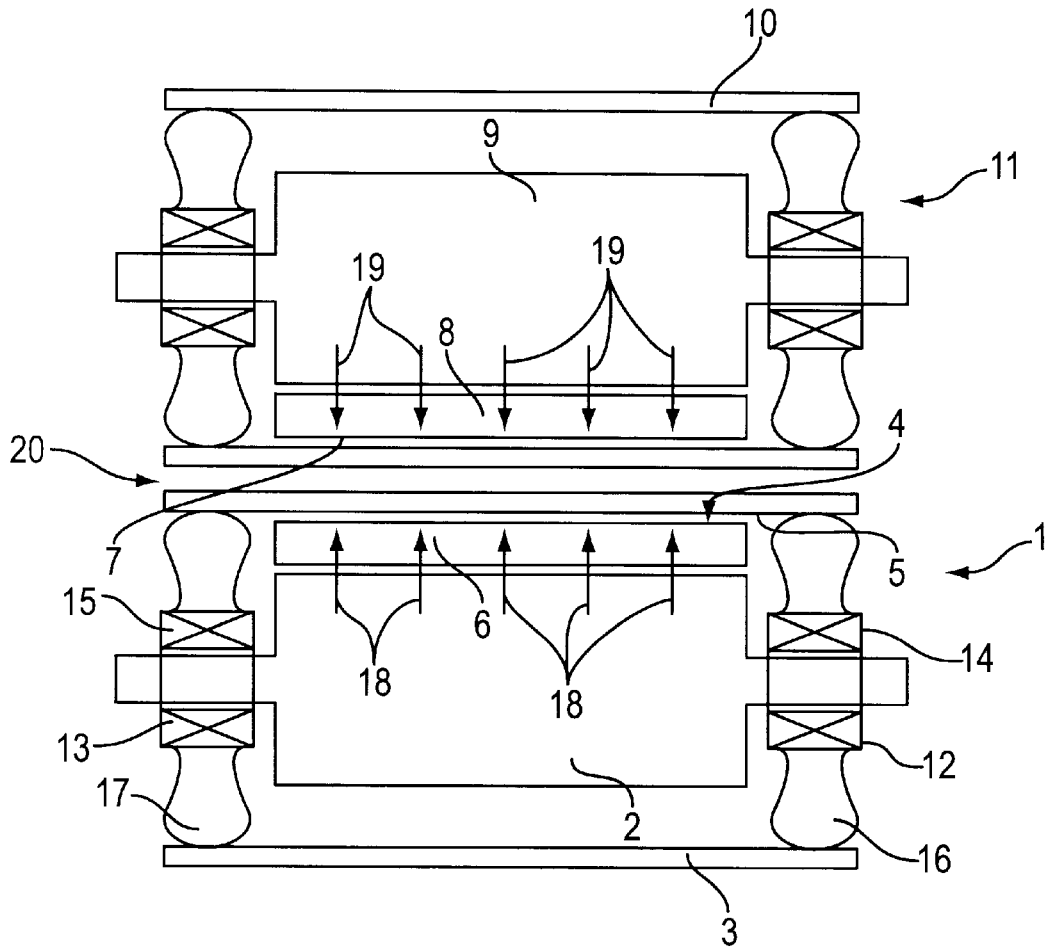
FIG. 1 illustrates a longitudinal vertical section of a shoe press according to one embodiment of the invention.
Figure 2:
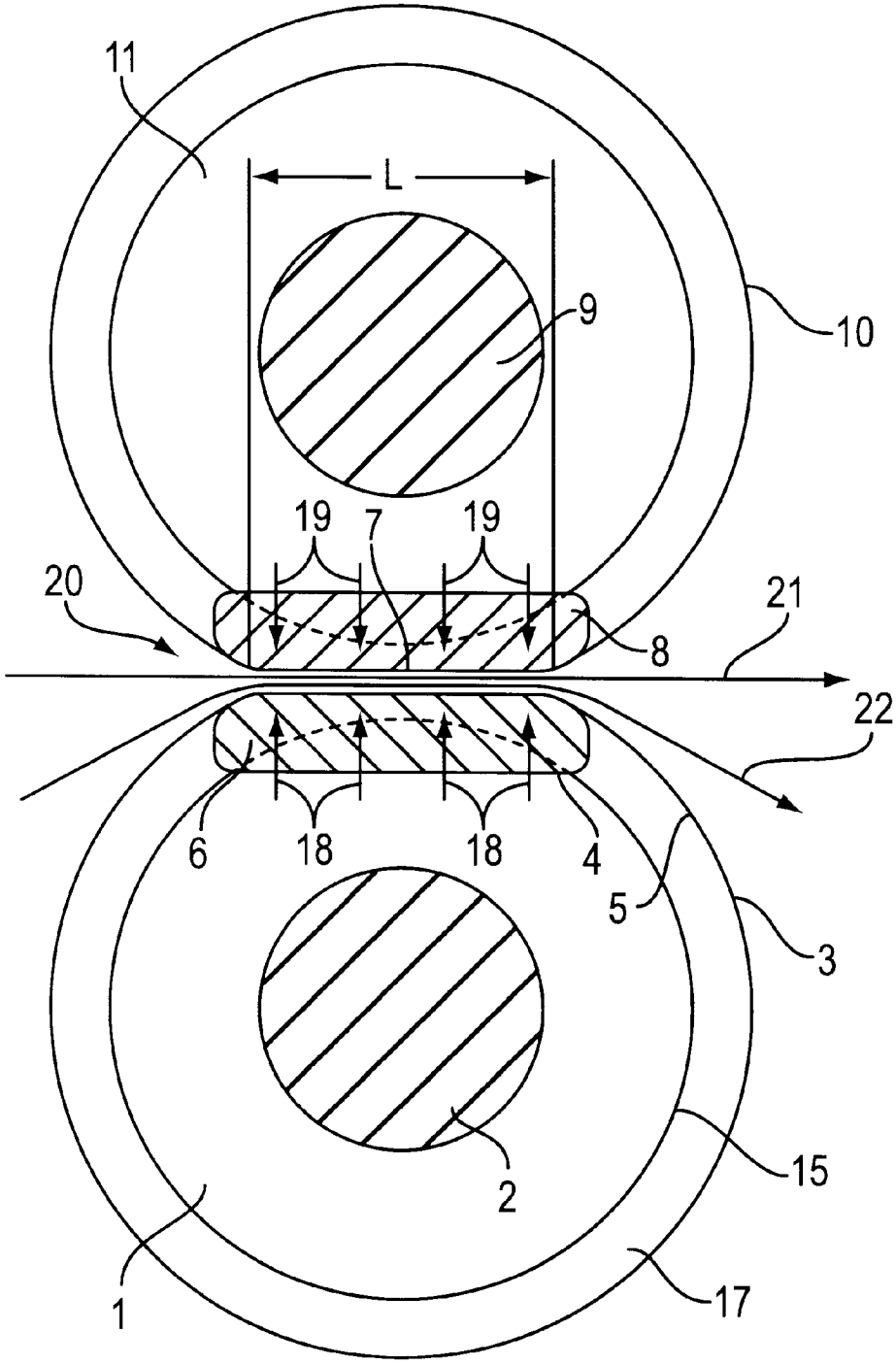
FIG. 2 illustrates a cross-section of the shoe press of FIG. 1.

The shoe press displayed in FIGS. 1 and 2 includes a press roll 1 with a flexible roll sleeve 3 circulating around a stationary carrier 2, and a first shoe 6 having an essentially flat support surface 4 for the interior side 5 of the roll sleeve 3. The first shoe 6 of roll 1 acts together with a second shoe 8, which has a flat support surface 7 that supports a flexible roll sleeve 10 of a second roll 11 circulating around a stationary carrier 9. The support surfaces 4 and 7 of the two shoes 6 and 8 thereby run essentially parallel to each other, preferably with a minimal average convergence in the run direction of roll sleeve 3.

To support the two axial end areas of roll sleeves 3, 10 of rolls 1, 11, side shields 12, 13 of rolls 1, 11 are designed as rims 14, 15 having air-filled tubes 16, 17. Rims 14, 15 are mounted in a rotatable fashion on stationary carriers 2, 9 while tubes 16, 17 are rigidly connected, in particular glued, to roll sleeves 3, 10. In this manner, radial support of the anal end areas of roll sleeves 3, 10 with radial elasticity is achieved.

As illustrated in FIG. 1, rolls 1, 11 are designed essentially symmetrical to each other with respect to the press opening 20 created between the rolls 1, 11. That is, the two roll sleeves 3, 10 each have the same width, and the flexible side shields 12, 13 are arranged in pairs, each opposite to one another. The shoes 6, 8 of both rolls also exhibit the same width and essentially the same length.

The shoes 6, 8 of rolls 1, 11 are each radially adjustable with respect to the corresponding stationary carrier 2 or 9, as shown by arrows 18 and 19. Preferably, only roll 1 is equipped with the means to regulate the contact pressure, while only roll 11 is equipped with means to compensate for the bending of stationary carrier 9 by radially adjusting shoe 8. Roll 1 also is a self-loading press roll. Roll 11 serves as a mating roll whose shoe 8 is rigidly connected with the stationary carrier 9 in at least one location, or preferably in two locations adjacent to the ends of shoe 8.

As illustrated in FIG. 2, a paper sheet 21 and a felt belt 22 on the side of the paper sheet 21 adjacent to roll 1 are guided through the press opening 20 created between rolls 1, 11. In principle, however, a felt belt can also be guided through press opening 20 on the opposite side of paper sheet 21.

During operation of the shoe press, a three-dimensional, alternating bending deformation of roll sleeves 3, 10 in the area between shoes 6, 8 and the supported end areas of roll sleeves 3, 10 is avoided. Moreover, this can be affected by adjusting the diameter of rims 14, 15. The loading stress of roll sleeves 3, 10 is noticeably decreased relative to a rigid support, such that the operational lifetime of roll sleeves 3, 10 is correspondingly extended.

Figure 3:
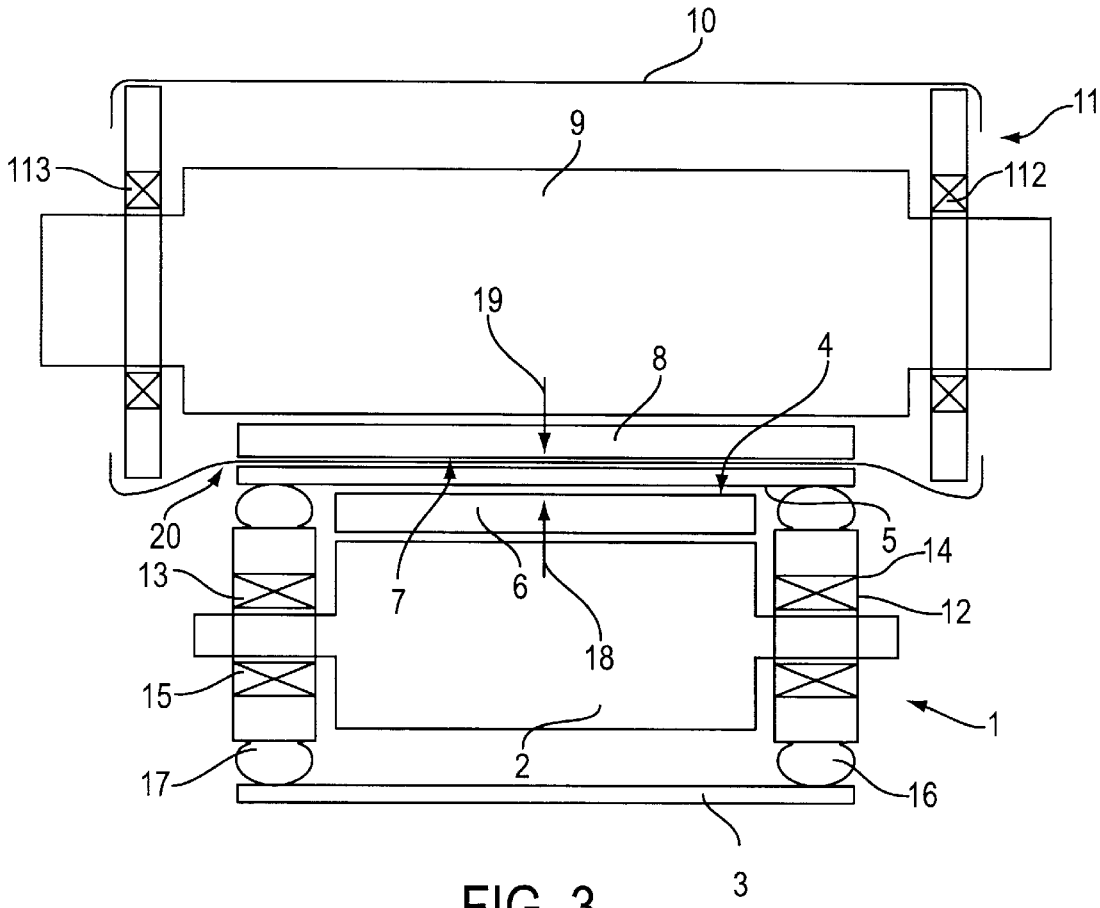
FIG. 3 illustrates a longitudinal vertical section of a shoe press according to another embodiment of the invention.
Figure 4:
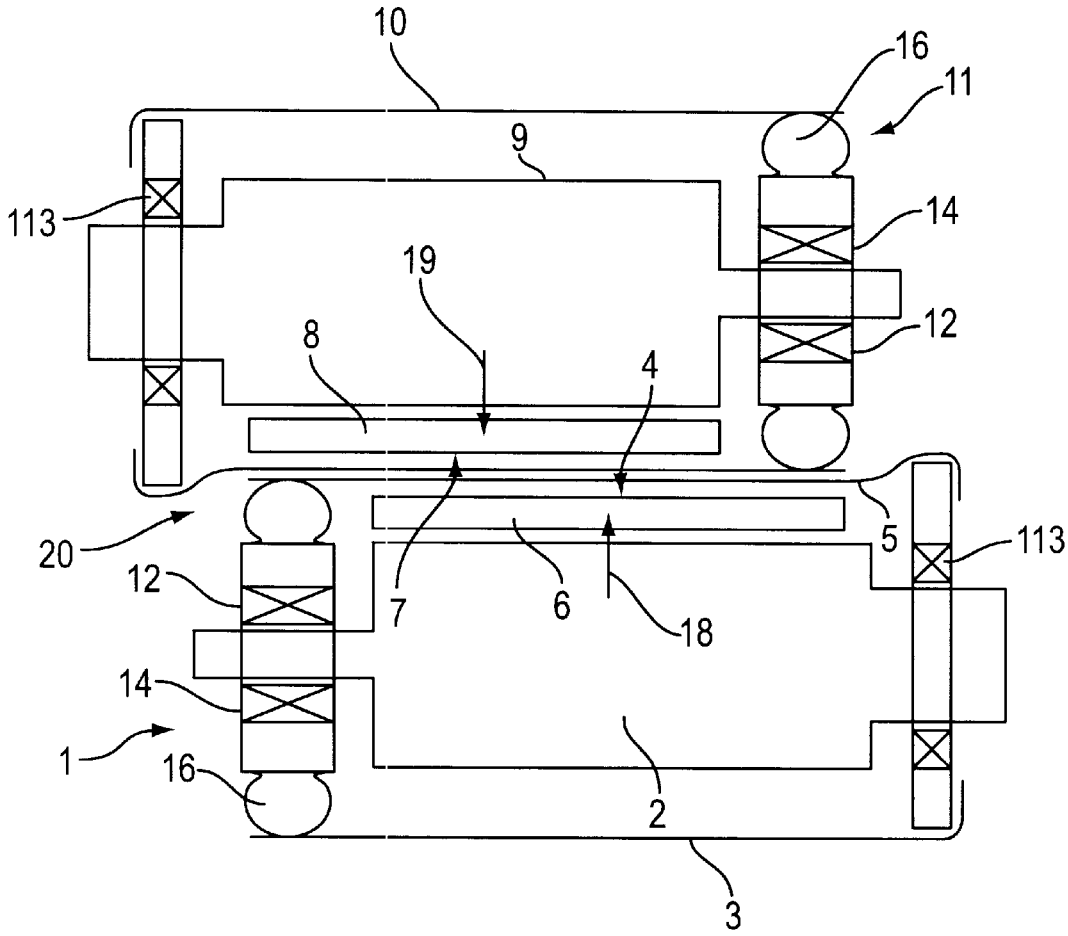
FIG. 4 illustrates a longitudinal vertical section of a shoe press according to yet another embodiment of the invention.

In further embodiments of the invention illustrated in FIG. 3 or in FIG. 4, rolls 1, 10 and in particular shoes 6, 8 are designed in basically the same manner as in embodiment illustrated in FIGS. 1 and 2. In particular, in FIGS. 3 and 5, shoes 6, 8 also have flat and essentially parallel support surfaces 4, 7.

In contrast to the first embodiment of the invention, however, in FIG. 3 only roll 1 is designed with radially flexible side shields 12, 13 in the form of rims 14, 15 provided with air-filled tubes 16, 17. The second roll 11 has rigid side shields 112, 113. In addition, the width of roll sleeve 10, as well as the width of shoe 8 of second roll 11, are greater than the respective widths of the first roll 1.

In particular, the width of roll sleeve 3 of first roll 1 corresponds essentially to the width of the shoe 8 of the second roll 11, so that the two flexible side shields 12, 13 of roll 1 are arranged opposite the two axial end of shoe 8 of the second roll 11. Consequently, tubes 16, 17 of roll 1 can be rotated against shoe 8 of second roll 11 during operation of the shoe press.

Here, unlike with the first embodiment, deformation of the axial end areas of roll sleeve 3, corresponding to the deformation of roll sleeve 3 in the areas of shoes 6, 8, is achieved by contact pressure of the flexible side shields 12, 13 of roll 11 on shoe 8 of second roll 11. Here it is also ensured that roll sleeve 3 between shoe 6 and side shields 12, 13 undergoes virtually no three dimensional alternating bending deformation. Due to the greater width of second roll 11, too great an alternating bending deformation between shoe 8 and the side shields 112, 113 also is avoided, in spite of side shields 112, 113 being radially rigid.

According to another embodiment of the invention illustrated in FIG. 4, rolls 1, 11 and their shoes 6, 8 once again have the same width. In addition, rolls 1, 11 are each equipped with a radially flexible side shield 12 and a radially rigid side shield 113 which are positioned at opposing axial ends of rolls 1, 11. Rolls 1, 11 are also arranged offset and opposite one another, in such a way that the radially flexible side shield 12 of each of the two rolls 1, 11 can be supported on an axial end of shoes 6, 8 placed opposite thereto. A press zone is thereby achieved with consistent and relatively little deformation of roll sleeves 3, 10.

Figure 5:
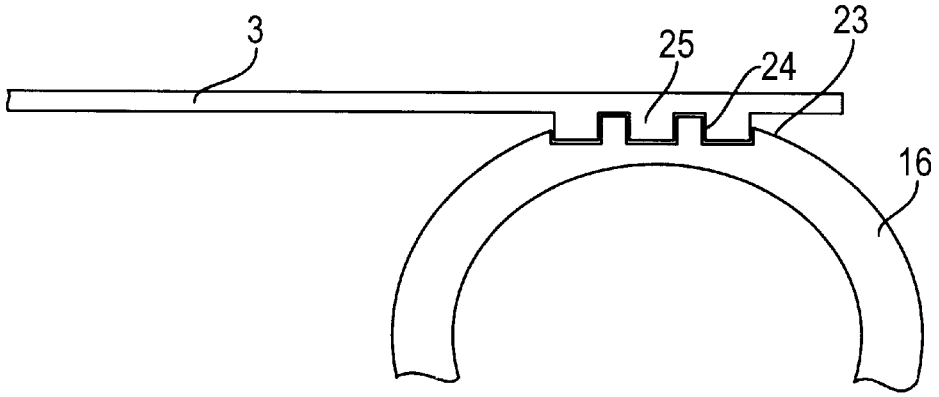
FIG. 5 illustrates one aspect of the shoe press of FIG. 1.

FIG. 5 illustrates one aspect of the press shoe of FIG. 1. In FIG. 5, tube 16 of roll 1 is designed with notches 24 on its contact surface 23 extending in the circumferential direction of the tube 16, into which are engaged the corresponding projecting pieces 25 on the interior side 5 of roll sleeve 3. An axially interlocking connection, as well as an increased contact surface, between the tube 16 and the roll sleeve 3 is hereby created, which if glued leads to increased strength. In the same way, all of the tubes 16, 17 can be connected with respective, corresponding roll sleeves 3, 10.

In accordance with the invention, the radially flexible, in particular elastic, support of roll sleeves 3, 10 on corresponding carriers 2, 9 enables consistent deformation of roll sleeves 3, 10 while passing through press opening 20. In particular, three-dimensional alternating bending deformations are essentially avoided, and therefore the stress on the roll sleeves 3, 10 is largely decreased. The lifetime of roll sleeves 3, 10 correspondingly is increased.

Roll sleeve support in accordance with the invention is particularly important when using a so-called flat nip, where two press shoes 6, 8 act together with flat, parallel support surfaces 4, 7. With such an arrangement, the contact pressure of the flexible support devices on a mating roll allows deformation in the axial end areas of roll sleeves 3, 10 which corresponds to the deformation of roll sleeves 3, 10 in the area of shoes 6, 8 which is sought to be achieved. In principle, however, roll sleeve support in accordance with the invention offers advantages when used with other press shoes as well.

It is noted that the foregoing examples have been provided merely for the purpose of explanations and are in no way to be construed as limiting of the present invention. While the invention has been described with reference to preferred embodiments, it is understood that the words which have been used herein are words of description and illustration, rather than words of limitation. Changes may be made, within the purview of the appended claims, as presently stated and as amended, without departing from the scope and spirit of the invention and its aspects. Although the invention has been described herein with reference to particular devices and embodiments, the invention is not intended to be limited to the particulars disclosed herein; rather, the invention extends to all functionally equivalent structures, methods and uses, such as are within the scope of the appended claims.

What is claimed is:

1. A shoe press comprising:

a press nip formed between at least a first press roll and a second press roll;

each of the first press roll and the second press roll comprising a flexible roll sleeve which rotates around a stationary carrier and a shoe with a flat support surface which engages an interior side of the flexible roll sleeve;

each flexible roll sleeve having axial end areas which are rotatably mounted about the stationary carrier via radially flexible support devices;

wherein the axial end areas of each flexible roll sleeve can flex radially with respect to each stationary carrier when each flexible roll sleeve rotates.

2. The shoe press of claim 1, wherein each shoe is horizontally disposed and has a left end and a right end, such that the right end of the shoe of the first press roll extends horizontally further to the right of the right end of the shoe of the second press roll.

3. The shoe press of claim 1, wherein the first press roll and the second press roll have essentially same diameter.

4. The shoe press of claim 1, wherein the press nip comprises a paper machine press nip.

5. The shoe press of claim 1, wherein at least one radially flexible support device comprises a radially flexibly elastic member.

6. The shoe press of claim 1, wherein the flexible roll sleeve of the first press roll has an axial length which substantially corresponds to the axial length of the flexible roll sleeve of the second press roll.

7. The shoe press of claim 1, wherein at least one radially flexible support device of the first press roll is substantially axially aligned with at least one radially flexible support device of the second press roll.

8. The shoe press of claim 1, wherein at least one radially flexible support device comprises an air filled tube which is fixed to the flexible roll sleeve.

9. The shoe press of claim 8, wherein the air filled tube rotates about the stationary carrier.

10. The shoe press of claim 8, wherein the air filled tube is disposed on a rim, the rim being rotatably mounted to the stationary carrier.

11. The shoe press of claim 10, wherein the air filled tube is fixed to the rim with a clamp.

12. The shoe press of claim 8, wherein the air filled tube is fixed to the flexible roll sleeve by one of glueing and an axially interlocking connection.

13. The shoe press of claim 8, wherein the air filled tube is fixed to the flexible roll sleeve by an axially interlocking connection which comprises notches and projecting pieces for engaging with the notches.

14. The shoe press of claim 8, further comprising an additional sealing tube within the air filled tube.

15. The shoe press of claim 1, wherein at least one radially flexible support device comprises a rim having a diameter which is adjustable via at least one radially adjustable element.

16. The shoe press of claim 1, wherein at least one shoe is radially adjustable with respect to the stationary carrier.

17. The shoe press of claim 1, wherein at least one radially flexible support device is variably adjustable.

18. A shoe press comprising:

a press nip formed between at least a first press roll and a second press roll;

each of the first press roll and the second press roll comprising a flexible roll sleeve which rotates around a stationary carrier and a shoe with a flat support surface which engages an interior side of the flexible roll sleeve;

the flexible roll sleeve of the first press roll having axial end areas which are rotatably mounted about the stationary carrier via rigid side shields;

the flexible roll sleeve of the second press roll having axial end areas which are rotatably mounted about a stationary carrier via radially flexible support devices;

wherein the axial end areas of the flexible roll sleeve of the second press roll can flex radially with respect to a stationary carrier when the flexible roll sleeve rotates.

19. The shoe press of claim 18, wherein the flexible roll sleeve of the second press roll has an axial length which substantially corresponds to a length of the shoe of the first press roll.

20. The shoe press of claim 18, wherein the flexible roll sleeve of the first press roll has an axial length which is greater than an axial length of the flexible roll sleeve of the second press roll.

21. The shoe press of claim 18, wherein at least one radially flexible support device comprises at least one air filled tube which is fixed to the flexible roll sleeve.

22. The shoe press of claim 21, wherein the air filled tube is disposed on a rim, the rim being rotatably mounted to the stationary carrier.

23. The shoe press of claim 22, wherein the air filled tube is fixed to the rim with a clamp.

24. The shoe press of claim 21, wherein the air filled tube is fixed to the flexible roll sleeve by one of glueing and an axially interlocking connection.

25. The shoe press of claim 21, wherein the air filled tube is fixed to the flexible roll sleeve by an axially interlocking connection which comprises notches and projecting pieces for engaging with the notches.

26. The shoe press of claim 18, wherein at least one radially flexible support device comprises a rim having a diameter which is adjustable via at least one radially adjustable element.

27. The shoe press of claim 18, wherein at least one rigid side shield comprises an inflexible support device in the form of an eccentric tightening disk.

28. The shoe press of claim 18, wherein at least one shoe is radially adjustable with respect to the stationary carrier.

29. The shoe press of claim 18, wherein at least one radially flexible support device is variably adjustable.

30. The shoe press of claim 18, wherein the press nip comprises a paper machine press nip.

31. The shoe press of claim 18, wherein at least one radially flexible support device comprises a radially flexibly elastic member.

32. A shoe press comprising:

a press nip formed between at least a first press roll and a second press roll;

each of the first press roll and the second press roll comprising a flexible roll sleeve which rotates around a stationary carrier and a shoe with a flat support surface which engages an interior side of the flexible roll sleeve;

each flexible roll sleeve having one axial end area which is rotatably mounted about the stationary carrier via a rigid side shield and another axial end area which is rotatably mounted about the stationary carrier via a radially flexible support device;

wherein one axial end area of each flexible roll sleeve can flex radially with respect to the stationary carrier when the flexible roll sleeve rotates.

33. The shoe press of claim 32, wherein the flexible roll sleeve of the first press roll has an axial length which substantially corresponds to an axial length of the flexible roll sleeve of the second press roll.

34. The shoe press of claim 32, wherein the radially flexible support device of the first press roll is substantially axially aligned with one end of the shoe of the second press roll.

35. The shoe press of claim 32, wherein the radially flexible support device of the first press roll is substantially axially aligned with one end of the shoe of the second press roll and wherein the radially flexible support device of the second press roll is substantially axially aligned with one end of the shoe of the first press roll.

36. The shoe press of claim 32, wherein at least one radially flexible support device comprises an air filled tube which is fixed to the flexible roll sleeve.

37. The shoe press of claim 36, wherein the air filled tube is fixed to the flexible roll sleeve by one of glueing and an axially interlocking connection.

38. The shoe press of claim 36, wherein the air filled tube is disposed on a rim, the rim being rotatably mounted to the stationary carrier.

39. The shoe press of claim 38, wherein the air filled tube is fixed to the rim with a clamp.

40. The shoe press of claim 36, wherein each air filled tube is fixed to the flexible roll sleeve by an axially interlocking connection which comprises notches and projecting pieces for engaging with the notches.

41. The shoe press of claim 36, further comprising an additional sealing tube within the air filled tube.

42. The shoe press of claim 32, wherein at least one radially flexible support device comprises a rim having a diameter which is adjustable via at least one radially adjustable elastic element.

43. The shoe press of claim 32, wherein at least one rigid side shield comprises an inflexible support device in the form of an eccentric tightening disk.

44. The shoe press of claim 32, wherein at least one shoe is radially adjustable with respect to the stationary carrier.

45. The shoe press of claim 32, wherein at least one radially flexible support device is variably adjustable.

46. The shoe press of claim 32, wherein the press nip comprises a paper machine press nip.

* * * * *